US007372043B2

(12) United States Patent
Joyce et al.

(10) Patent No.: US 7,372,043 B2
(45) Date of Patent: May 13, 2008

(54) APPARATUS AND METHOD FOR ION PRODUCTION ENHANCEMENT

(75) Inventors: Timothy H. Joyce, Loveland, CO (US); Jean-Luc Truche, Loveland, CO (US); Jian Bai, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 329 days.

(21) Appl. No.: 11/155,070

(22) Filed: Jun. 16, 2005

(65) Prior Publication Data

US 2005/0274905 A1 Dec. 15, 2005

Related U.S. Application Data

(63) Continuation-in-part of application No. 11/041,118, filed on Jan. 21, 2005, now Pat. No. 7,135,689, which is a continuation-in-part of application No. 10/966,278, filed on Oct. 15, 2004, now Pat. No. 7,091,482, which is a continuation of application No. 10/080,879, filed on Feb. 22, 2002, now Pat. No. 6,825,462.

(51) Int. Cl.
*H01J 27/00* (2006.01)

(52) U.S. Cl. ..... 250/425; 250/424; 250/423 R; 250/429; 250/281; 250/282; 250/283; 250/286; 250/288

(58) Field of Classification Search ..... 250/281, 250/282, 283, 288, 423 R, 424, 425, 429
See application file for complete search history.

(56) References Cited

U.S. PATENT DOCUMENTS

| | | | |
|---|---|---|---|
| 4,098,589 | A | 7/1978 | Buswell et al. |
| 4,531,056 | A | 7/1985 | Labowsky et al. |
| 4,766,741 | A | 8/1988 | Bartlett et al. |
| 4,796,433 | A | 1/1989 | Bartlett |
| 4,968,885 | A | 11/1990 | Willoughby |
| 5,022,379 | A | 6/1991 | Wilson, Jr. |
| 5,208,458 | A | 5/1993 | Busch et al. |
| 5,285,064 | A | 2/1994 | Willoughby |
| 5,498,545 | A | 3/1996 | Vestal |
| 5,560,216 | A | 10/1996 | Holmes |

(Continued)

FOREIGN PATENT DOCUMENTS

| | | |
|---|---|---|
| DE | 2227392 | 1/1974 |

OTHER PUBLICATIONS

Agilent Technologies, Agilent 1100 Series, at http://www.chem.agilent.com/Scripts/PDS.asp?1Page (Apr. 14, 2001).

(Continued)

*Primary Examiner*—Jack Berman
*Assistant Examiner*—Meenakshi S Sahu

(57) ABSTRACT

The invention described herein provides a matrix-based ion source including a gas heating device for providing heated gas at a defined temperature to the ionization region of the ion source. The ion source may also include a temperature sensor. The heating device and temperature sensor may be operably connected to work as a closed feedback loop to provide gas at a constant, pre-determined, temperature to the ionization region. Also disclosed is a mass spectrometer system having the matrix-based ion source. A method of producing ions employing gas that is heated to a pre-determined temperature is also provided.

26 Claims, 13 Drawing Sheets

U.S. PATENT DOCUMENTS

| | | | | |
|---|---|---|---|---|
| 5,869,832 | A | 2/1999 | Wang et al. | |
| 5,917,185 | A | 6/1999 | Yeung et al. | |
| 5,962,851 | A | 10/1999 | Whitehouse et al. | |
| 5,965,884 | A | 10/1999 | Laiko et al. | |
| 6,040,575 | A | 3/2000 | Whitehouse et al. | |
| 6,107,626 | A | 8/2000 | Wang et al. | |
| 6,140,639 | A | 10/2000 | Gusev et al. | |
| 6,154,608 | A | 11/2000 | Rochelle | |
| 6,175,112 | B1 | 1/2001 | Karger et al. | |
| 6,204,500 | B1 | 3/2001 | Whitehouse et al. | |
| 6,479,828 | B2 | 11/2002 | Perel | |
| 6,504,150 | B1 | 1/2003 | Verentchikov et al. | |
| 6,825,462 | B2 * | 11/2004 | Truche et al. | 250/288 |
| 7,091,483 | B2 * | 8/2006 | Fischer et al. | 250/288 |
| 7,132,670 | B2 * | 11/2006 | Truche et al. | 250/425 |
| 2005/0151090 | A1 * | 7/2005 | Truche et al. | 250/425 |

OTHER PUBLICATIONS

Burle, 5902 Magnum Electron Multiplier, at http://www.burle.com/pdf/5902 mag.pdf.

Ryan M. Danell et al. "Heating to Maximize AP-MALDI Performance: Evidence for Desolvation," May 17-31, 2001.

Victor V. Laiko et al, "Atmospheric Pressure MALDI/Ion Trap Mass Spectrometry," Anal. Chem., 2000, p. 5239-5243.

Victor V. Laiko et al. "Atmospheric Pressure Matrix-Assisted Laser Desorption/Ionization Mass Spectrometry," Anal. Chem. 2000, p. 652-657.

* cited by examiner

APPARATUS AND METHOD FOR ION PRODUCTION ENHANCEMENT

CROSS-REFERENCE

This patent application is a continuation-in-part of Ser. No. 11/041,118, filed Jan. 21, 2005, which application is a continuation-in-part of Ser. No. 10/966,278, filed Oct. 15, 2004, which application is a continuation of Ser. No. 10/080,879, filed Feb. 22, 2002 and now issued as U.S. Pat. No. 6,825,462. The contents of these patent applications are incorporated by reference herein in their entirety for all purposes.

BACKGROUND

Most complex biological and chemical targets require the application of complementary multidimensional analysis tools and methods to compensate for target and matrix interferences. Correct analysis and separation is important to obtain reliable quantitative and qualitative information about a target. In this regard, mass spectrometers have been used extensively as detectors for various separation methods. However, until recently most spectral methods provided fragmentation patterns that were too complicated for quick and efficient analysis. The introduction of atmospheric pressure ionization (API) and matrix assisted laser desorption ionization (MALDI) has improved results substantially. For instance, these methods provide significantly reduced fragmentation patterns and high sensitivity for analysis of a wide variety of volatile and non-volatile compounds. The techniques have also had success on a broad based level of compounds including peptides, proteins, carbohydrates, oligosaccharides, natural products, cationic drugs, organoarsenic compounds, cyclic glucans, taxol, taxol derivatives, metalloporphyrins, porphyrins, kerogens, cyclic siloxanes, aromatic polyester dendrimers, oligodeoxynucleotides, polyaromatic hydrocarbons, polymers and lipids.

According to the MALDI method of ionization, the analyte and matrix is applied to a metal probe or target substrate. As the solvent evaporates, the analyte and matrix co-precipitate out of solution to form a solid solution of the analyte in the matrix on the target substrate. The co-precipitate is then irradiated with a short laser pulse inducing the accumulation of a large amount of energy in the co-precipitate through electronic excitation or molecular vibration of the matrix molecules. The matrix dissipates the energy by desorption, carrying along the analyte into the gaseous phase. During this desorption process, ions are formed by charge transfer between the photo-excited matrix and analyte.

Conventionally, the MALDI technique of ionization is performed using a time-of-flight analyzer, although other mass analyzers such as an ion trap, an ion cyclotron resonance mass spectrometer and quadrupole time-of-flight are also used. These analyzers, however, must operate under high vacuum, which among other things may limit the target throughput, reduce resolution, capture efficiency, and make testing targets more difficult and expensive to perform.

To overcome the above mentioned disadvantages in MALDI, a technique referred to as AP-MALDI has been developed. This technique employs the MALDI technique of ionization, but at atmospheric pressure. The MALDI and the AP-MALDI ionization techniques have much in common. For instance, both techniques are based on the process of pulsed laser beam desorption/ionization of a solid-state target material resulting in production of gas phase analyte molecular ions. However, the AP-MALDI ionization technique does not rely on a pressure differential between the ionization chamber and the mass spectrometer to direct the flow of ions into the inlet orifice of the mass spectrometer.

AP-MALDI can provide detection of a molecular mass up to $10^6$ Da from a target size in the attamole range. In addition, as large groups of proteins, peptides or other compounds are being processed and analyzed by these instruments, levels of sensitivity become increasingly important. Various structural and instrument changes have been made to MALDI mass spectrometers in an effort to improve sensitivity. Additions of parts and components, however, provides for increased instrument cost. In addition, attempts have been made to improve sensitivity by altering the analyte matrix mixed with the target. These additions and changes, however, have provided limited improvements in sensitivity with added cost.

Thus, there is a need to improve the sensitivity and results of AP-MALDI mass spectrometers for increased and efficient ion enhancement.

SUMMARY OF THE INVENTION

The present invention relates to an apparatus and method for use with a mass spectrometer. The invention provides an ion enhancement system for providing a heated gas flow to enhance analyte ions produced by a matrix based ion source and detected by a detector. The mass spectrometer of the present invention provides a matrix based ion source for producing analyte ions, an ion detector downstream from the matrix based ion source for detecting enhanced analyte ions, an ion enhancement system interposed between the ion source and the ion detector for enhancing the analyte ions, and an ion transport system adjacent to or integrated with the ion enhancement system for transporting the enhanced analyte ions from the ion enhancement system to the detector.

In addition, the invention also provides a matrix-based ion source comprising a gas heating device for providing heated gas at a defined temperature to an ionization region of the ion source. The ion source may also comprise a temperature sensor. The heating device and temperature sensor may be coupled in a closed feedback loop to provide gas at a constant, pre-determined, temperature to the ionization region. Also disclosed is a mass spectrometer system comprising a matrix-based ion source. The invention also provides a method of producing ions in an ion source containing gas that is heated to a pre-determined temperature.

The method of the present invention comprises producing analyte ions from a matrix based ion source, enhancing the analyte ions with an ion enhancement system, and detecting the enhanced analyte ions with a detector.

BRIEF DESCRIPTION OF THE FIGURES

The invention is described in detail below with reference to the following figures.

DETAILED DESCRIPTION OF THE INVENTION

Figure 1:
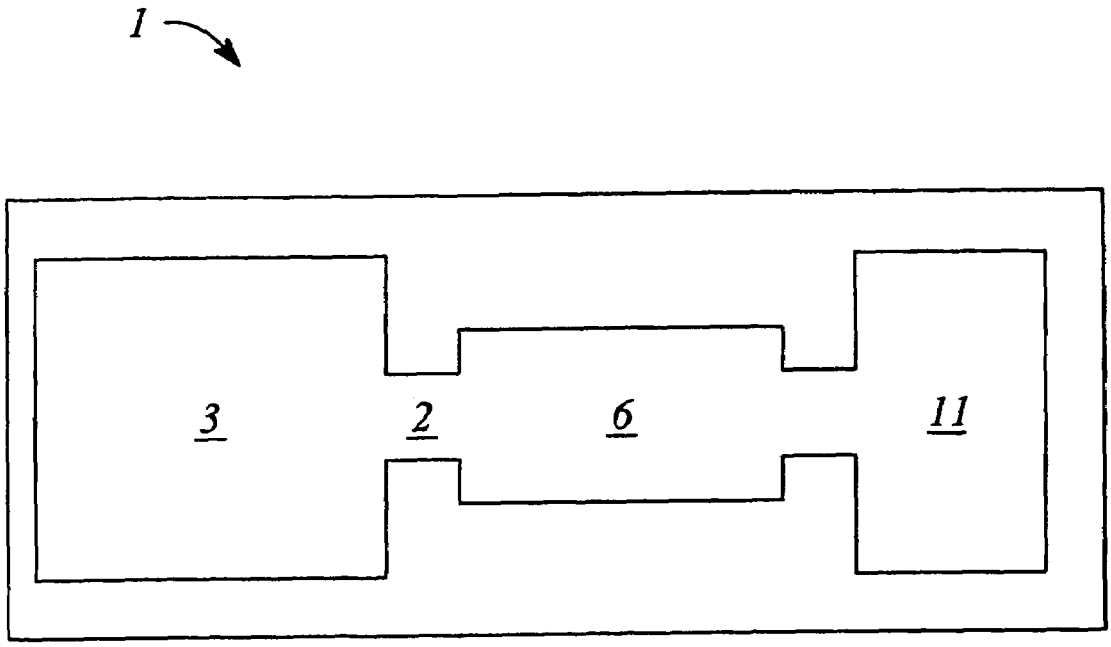
FIG. 1 shows general block diagram of a mass spectrometer.

Before describing the invention in detail, it must be noted that, as used in this specification and the appended claims, the singular forms "a," "an," and "the" include plural referents unless the context clearly dictates otherwise. Thus, for example, reference to "a conduit" includes more than one "conduit". Reference to a "matrix" includes more than one "matrix" or a mixture of "matrixes". In describing and claiming the present invention, the following terminology will be used in accordance with the definitions set out below.

The term "adjacent" means, near, next to or adjoining. Something adjacent may also be in contact with another component, surround the other component, be spaced from the other component or contain a portion of the other component. For instance, a capillary that is adjacent to a conduit may be spaced next to the conduit, may contact the conduit, may surround or be surrounded by the conduit, may contain the conduit or be contained by the conduit, may adjoin the conduit or may be near the conduit.

The term "conduit" or "heated conduit" refers to any sleeve, transport device, dispenser, nozzle, hose, pipe, plate, pipette, port, connector, tube, coupling, container, housing, structure or apparatus that may be used to direct a heated gas or gas flow toward a defined region in space such as an ionization region. In particular, the "conduit" may be designed to enclose a capillary or portion of a capillary that receives analyte ions from an ion source. The term should be interpreted broadly, however, to also include any device, or apparatus that may be oriented toward the ionization region and which can provide a heated gas flow toward or into ions in the gas phase and/or in the ionization region. For instance, the term could also include a concave or convex plate with an aperture that directs a gas flow toward the ionization region.

The term "enhance" refers to any external physical stimulus such as heat, energy, light, or temperature change, etc. that makes a substance more easily characterized or identified. For example, a heated gas may be applied to "enhance" ions. The ions increase their kinetic energy, potentials or motions and are declustered or vaporized. Ions in this state are more easily detected by a mass analyzer. It should be noted that when the ions are "enhanced", the number of ions detected is enhanced since a higher number of analyte ions are sampled through a collecting capillary and carried to a mass analyzer or detector.

The term "ion source" or "source" refers to any source that produces analyte ions. Ion sources may include other sources besides AP-MALDI ion sources such as electron impact (herein after referred to as EI), chemical ionization (CI) and other ion sources known in the art. The term "ion source" refers to the laser, target substrate, and target to be ionized on the target substrate. The target substrate in AP-MALDI may include a grid for target deposition. Spacing between targets on such grids is around 1-0 mm. Approximately 0.5 to 2 microliters is deposited on each site on the grid.

The term "ionization region" refers to the area between the ion source and the collecting capillary. In particular, the term refers to the analyte ions produced by the ion source that reside in that region and which have not yet been channeled into the collecting capillary. This term should be interpreted broadly to include ions in, on, about or around the target support as well as ions in the heated gas phase above and around the target support and collecting capillary. The ionization region in AP MALDI is around 1-5 mm in distance from the ion source (target substrate) to a collecting capillary (or a volume of 1-5 mm ). The distance from the target substrate to the conduit is important to allow ample gas to flow from the conduit toward the target and target substrate. For instance, if the conduit is too close to the target or target substrate, then arcing takes place when voltage is applied. If the distance is too far, then there is no efficient ion collection.

The term "ion enhancement system" refers to any device, apparatus or components used to enhance analyte ions. The term does not include directly heating a capillary to provide conductive heat to an ion stream. For example, an "ion enhancement system" comprises a conduit and a gas source. An ion enhancement system may also include other devices well known in the art such as a laser, infrared red device, ultraviolet source or other similar type devices that may apply heat or energy to ions released into the ionization region or in the gas phase.

The term "ion transport system" refers to any device, apparatus, machine, component, capillary, that shall aid in the transport, movement, or distribution of analyte ions from one position to another. The term is broad based to include ion optics, skimmers, capillaries, conducting elements and conduits.

The terms "matrix based", or "matrix based ion source" refers to an ion source or mass spectrometer that does not require the use of a drying gas, curtain gas, or desolvation step. For instance, some systems require the use of such gases to remove solvent or cosolvent that is mixed with the analyte. These systems often use volatile liquids to help form smaller droplets. The above term applies to both nonvolatile liquids and solid materials in which the sample is dissolved. The term includes the use of a cosolvent. Cosolvents may be volatile or nonvolatile, but must not render the final matrix material capable of evaporating in vacuum. Such materials would include, and not be limited to m-nitrobenzyl alcohol (NBA), glycerol, triethanolamine (TEA), 2,4-dipentylphenol,1,5-dithiothrietol/dierythritol (magic bullet), 2-nitrophenyl octyl ether (NPOE), thioglycerol, nicotinic acid, cinnamic acid, 2,5-dihydroxy benzoic acid (DHB), 3,5~dimethoxy-4-hydroxycinnamic acid (sinpinic acid), a-cyano-4-hydroxycinnamic acid (CCA), 3-methoxy-4-hydroxycinnamic acid (ferulic acid), monothioglycerol, carbowax, 2-(4-hydroxyphenylazo)benzoic acid (HABA), 3,4-dihydroxycinnamic acid (caffeic acid), 2-amino-4-methyl-5-nitropvridine with their cosolvents and derivatives. In particular the term refers to MALDI, AP-MALDI, fast atom/ion bombardment (FAB) and other similar systems that do not require a volatile solvent and may be operated above, at, and below atmospheric pressure.

The term "gas flow", "gas", or "directed gas" refers to any gas that is directed in a defined direction in a mass spectrometer. The term should be construed broadly to include monatomic, diatomic, triatomic and polyatomic molecules that can be passed or blown through a conduit. The term should also be construed broadly to include mixtures, impure mixtures, or contaminants. The term includes both inert and non-inert matter. Common gases used with the present invention could include and not be limited to ammonia, carbon dioxide, helium, fluorine, argon, xenon, nitrogen, air etc.

The term "gas source" refers to any apparatus, machine, conduit, or device that produces a desired gas or gas flow. Gas sources often produce regulated gas flow, but this is not required.

The term "capillary" or "collecting capillary" shall be synonymous and will conform with the common definition(s) in the art. The term should be construed broadly to include any device, apparatus, tube, hose or conduit that may receive ions.

The term "detector" refers to any device, apparatus, machine, component, or system that can detect an ion. Detectors may or may not include hardware and software. In a mass spectrometer the common detector includes and/or is coupled to a mass analyzer.

A "plurality" is at least 2, e.g., 2, 3, 4, 6, 8, 10, 12 or greater than 12. The phrases "a plurality of" and "multiple" are used interchangeably. A plurality of conduits or gas streams contains at least a first conduit or gas stream and a second conduit or gas stream, respectively.

An ion source described herein may have an ambient pressure (i.e., a temperature within the housing of the ion source) of below 100 mTorr or at least 100 mTorr. In certain embodiments an ion source may have an ambient pressure that is atmospheric pressure (approximately 760 Torr), or high vacuum pressure, for example.

A "closed feedback loop" is a system in which the temperature of a region in an ion source is controlled by feedback from a temperature sensor in that region. A closed feedback loop generally contains at least a gas heating device and a temperature sensor that are coupled. A thermostatically-controlled system contains one example of a closed feedback loop.

A "thermostat" is a device that senses temperature and automatically responds to changes in temperature by switching on and off a gas heating device.

A "gas heating device" includes any suitable type of device for heating gas. A gas heating device may heat gas by convection, conduction or radiation, for example. A gas heating device may be part of or associated with a source of gas (e.g., a gas cylinder), a gas transport conduit, or a housing of an ion source, for example. Gas may be heated by a gas heating device after, during or prior to its entrance into the ion source.

The invention is described with reference to the figures. The figures are not to scale, and in particular, certain dimensions may be exaggerated for clarity of presentation.

FIG. 1 shows a general block diagram of a mass spectrometer. The block diagram is not to scale and is drawn in a general format because the present invention may be used with a variety of different types of mass spectrometers. A mass spectrometer 1 of the present invention comprises an ion source 3, an ion enhancement system 2, an ion transport system 6 and a detector 11. The ion enhancement system 2 may be interposed between the ion source 3 and the ion detector 11 or may comprise part of the ion source 3 and/or part of the ion transport system 6.

The ion source 3 may be located in a number of positions or locations. In addition, a variety of ion sources may be used with the present invention. For instance, EI, CI or other ion sources well known in the art may be used with the invention.

The ion enhancement system 2 may comprise a conduit 9 and a gas source 7. Further details of the ion enhancement system 2 are provided in FIGS. 2-3. The ion enhancement system 2 should not be interpreted to be limited to just these two configurations or embodiments.

The ion transport system 6 is adjacent to the ion enhancement system 2 and may comprise a collecting capillary 7 or any ion optics, conduits or devices that may transport analyte ions and that are well known in the art.

Figure 2:
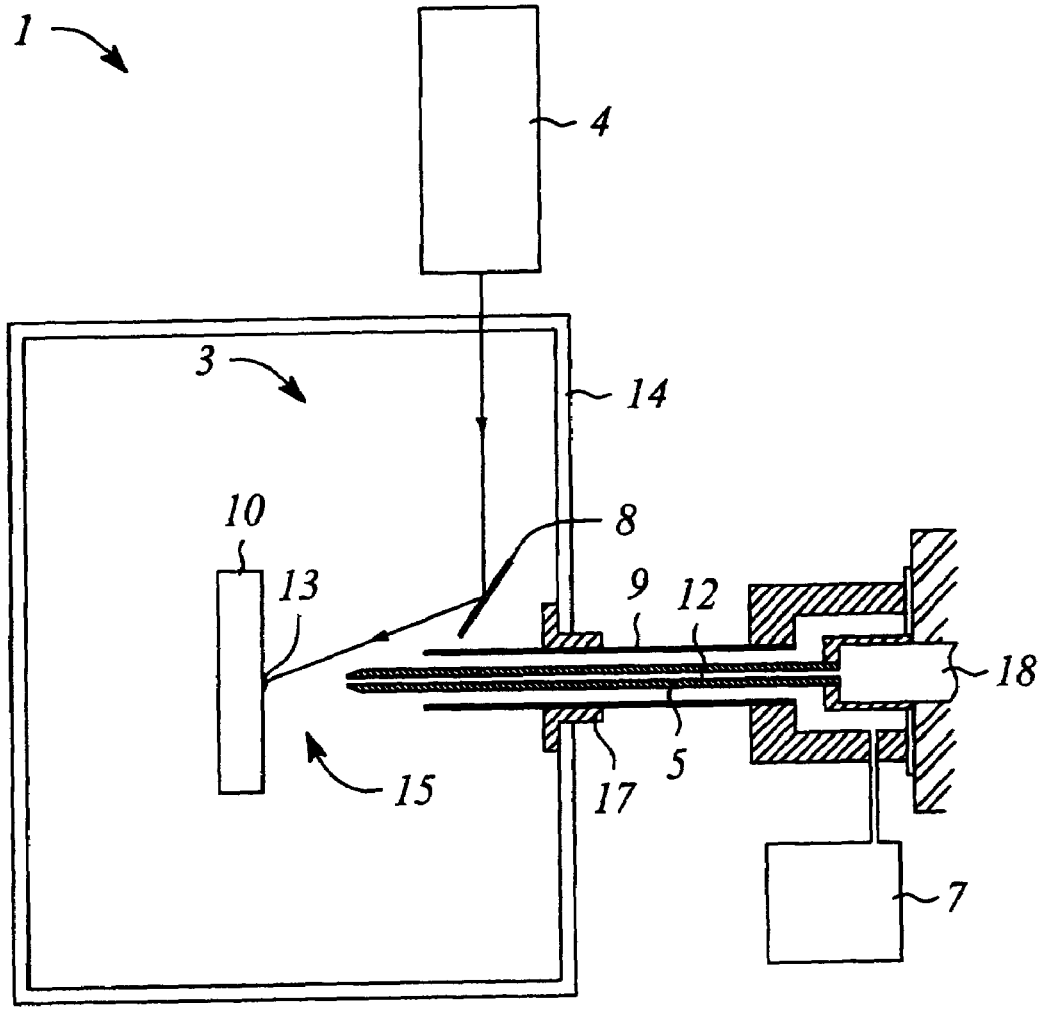
FIG. 2 shows a first embodiment of the present invention.

FIG. 2 shows a cross-sectional view of a first embodiment of the invention. The figure shows the present invention applied to an AP-MALDI mass spectrometer system. For simplicity, the figure shows the invention with a source housing 14. The use of the source housing 14 to enclose the ion source and system is optional. Certain parts, components and systems may or may not be under vacuum. These techniques and structures are well known in the art.

The ion source 3 comprises a laser 4, a deflector 8 and a target support 10. A target 13 is applied to the target support 10 in a matrix material well known in the art. The laser 4 provides a laser beam that is deflected by the deflector 8 toward the target 13. The target 13 is then ionized and the analyte ions are released as an ion plume into an ionization region 15.

The ionization region 15 is located between the ion source 3 and the collecting capillary 5. The ionization region 15 comprises the space and area located in the area between the ion source 3 and the collecting capillary 5. This region contains the ions produced by ionizing the sample that are vaporized into a gas phase. This region can be adjusted in size and shape depending upon how the ion source 3 is arranged relative to the collecting capillary 5. Most importantly, located in this region are the analyte ions produced by ionization of the target 13.

The collecting capillary 5 is located downstream from the ion source 3 and may comprise a variety of material and designs that are well known in the art. The collecting capillary 5 is designed to receive and collect analyte ions produced from the ion source 3 that are discharged as an ion plume into the ionization region 15. The collecting capillary 5 has an aperture and/or elongated bore 12 that receives the analyte ions and transports them to another capillary or location. In FIG. 2 the collecting capillary 5 is connected to a main capillary 18 that is under vacuum and further downstream. The collecting capillary 5 may be supported in place by an optional insulator 17. Other structures and devices well known in the art may be used to support the collecting capillary 5.

Important to the invention is the conduit 9. The conduit 9 provides a flow of heated gas toward the ions in the ionization region 15. The heated gas interacts with the analyte ions in the ionization region 15 to enhance the analyte ions and allow them to be more easily detected by the detector 11 (not shown in FIG. 2). These ions include the ions that exist in the heated gas phase. The detector 11 is located further downstream in the mass spectrometer (see FIG. 1). The conduit 9 may comprise a variety of materials and devices well known in the art. For instance, the conduit 9 may comprise a sleeve, transport device, dispenser, nozzle, hose, pipe, pipette, port, connector, tube, coupling, container, housing, structure or apparatus that is used to direct a heated gas or gas flow toward a defined region in space or location such as the ionization region 15. It is important to the invention that conduit 9 be positioned sufficiently close to the target 13 and the target support 10 so that a sufficient amount of heated gas can be applied to the ions in the ionization region 15.

Figure 3:
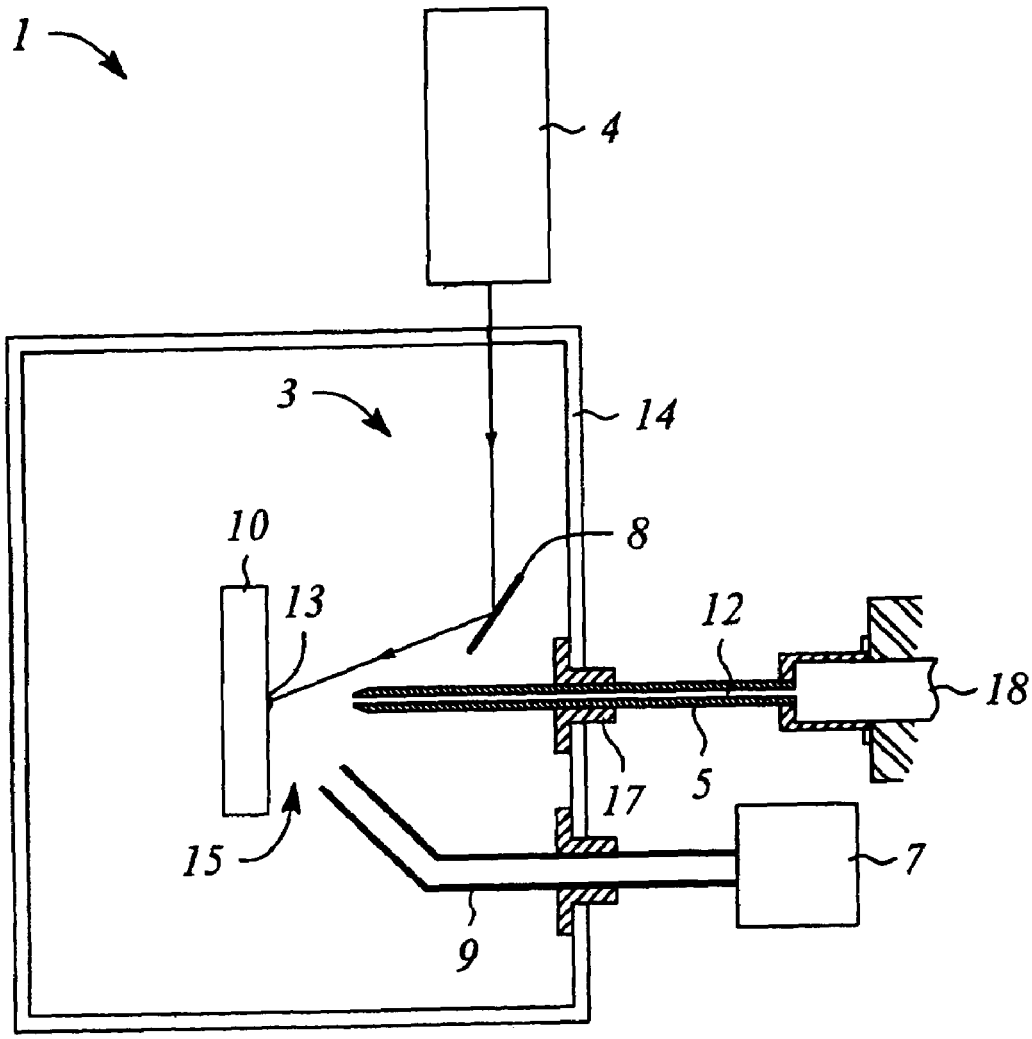
FIG. 3 shows a second embodiment of the present invention.

The gas source 7 provides the heated gas to the conduit 9. The gas source 7 may comprise any number of devices to provide heated gas. Gas sources are well known in the art and are described elsewhere. The gas source 7 may be a separate component as shown in FIGS. 2-3 or may be integrated with a coupling 23 (shown in FIG. 4) that operatively joins the collecting capillary 5, the conduit 9 and the main capillary 18. The gas source 7, may provide a number of gases to the conduit 9. For instance, gases such as nitrogen, argon, xenon, carbon dioxide, air, helium etc. may be used with the present invention. The gas need not be inert and should be capable of carrying a sufficient quantum of energy or heat. Other gases well known in the art that contain these characteristic properties may also be used with the present invention.

FIG. 3 shows a cross sectional view of a second embodiment of the present invention. The conduit 9 may be oriented in any number of positions to direct gas toward the ionization region 15. FIG. 3 in particular shows the conduit 9 in detached mode from the collecting capillary 5. It is important to the invention that the conduit 9 be capable of directing a sufficient flow of heated gas to provide enhancement to the analyte ions located in the ionization region 15. The conduit 9 can be positioned from around 1-5 mm in distance from the target 13 or the target support 10. The heated gas applied to the target 13 and the target support 10 should be in the temperature range of about 60-150 degrees Celsius. The gas flow rate should be approximately 2-15 L/minute.

Molecules generally move from the target support to the entrance of the ion collection capillary in the same direction as they are transported through the ion collection capillary. Accordingly, for the purposes of this disclosure, a ion source of the invention may contain an axis of ion movement defined by the longitudinal axis of the ion collection capillary, i.e., the ion collection capillary comprises a longitudinal axis that the ions move along. Further, for the purposes of this disclosure, the axis of heated gas flow is defined by the longitudinal axis of the conduit that provides the heated gas, i.e., a molecular axis that the heated gas moves along.

In certain embodiments and as illustrated in FIGS. 2 and 3, the axis of gas flow may be at any angle from 0° and 360°, including the angles of 0° and 360°, relative to the axis of ion movement from the target substrate to the entrance of the ion collection capillary. For example, the axis of gas flow may be opposing or anti-parallel (i.e. about 180 degrees), parallel (i.e., about 0 degrees) or orthogonal to the axis of ion flow, or any angle therebetween.

In certain embodiments, the direction of flow of the heated gas is at any angle in the following ranges: of 0-30 degrees, 30-60 degrees, 60-90 degrees, 90-120 degrees, 120-150 degrees, 150-180 degrees, 180-210 degrees, 210-240 degrees, 240-270 degrees, 270-300 degrees, 300-330 degrees, 330-360 degrees with respect to the axis of ion flow. In particular embodiments, the axis heated gas is oriented orthogonally to the axis of ion movement.

The angles listed above may be any angle in two or three dimensional space. In other words, the angle may be in an x/y plane (i.e., in the same plane as FIG. 3), or in a z plane (i.e., the axis of heated gas may be oriented above or below the x/y plane of FIG. 3) or a combination thereof. In other words, viewed from the side (as shown in FIG. 3) or from "above" (e.g., from the entrance of the ion collection capillary) the axis of heated gas may be at any angle relative to the axis of ion transport.

Figure 4:
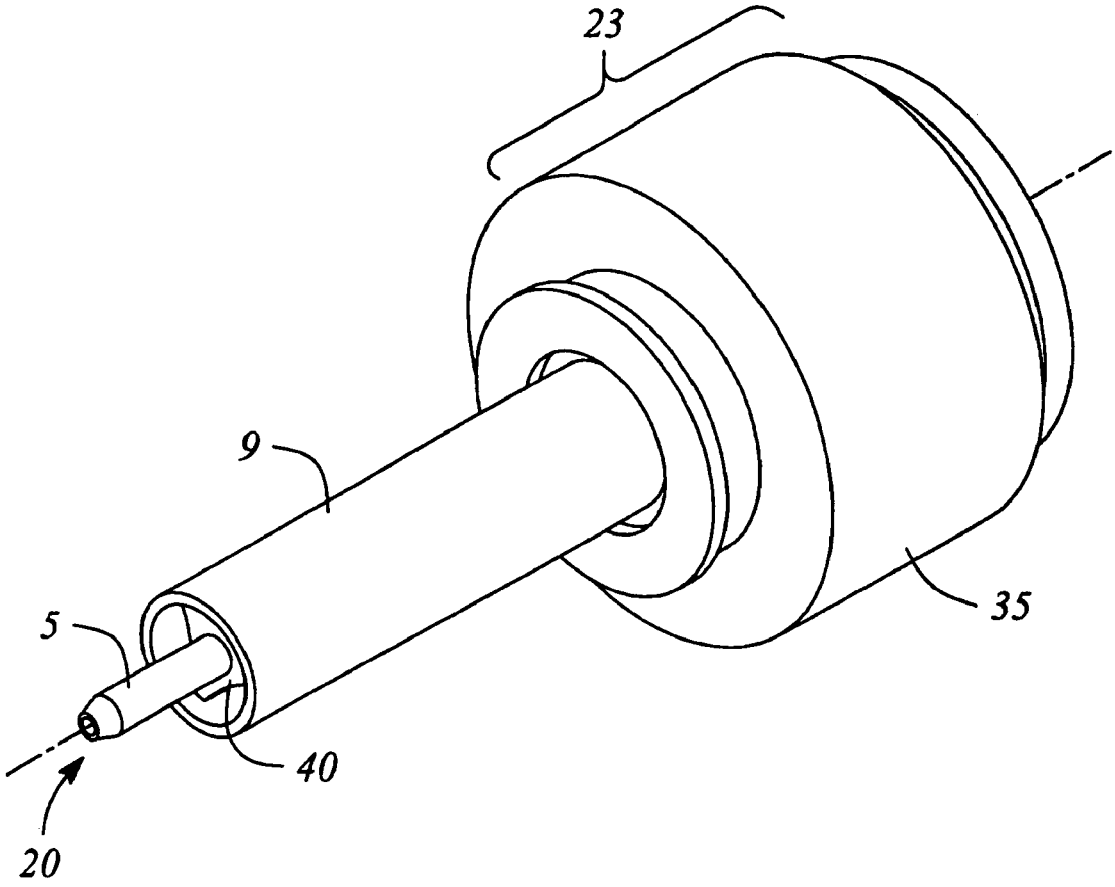
FIG. 4 shows a perspective view of the first embodiment of the invention.
Figure 5:
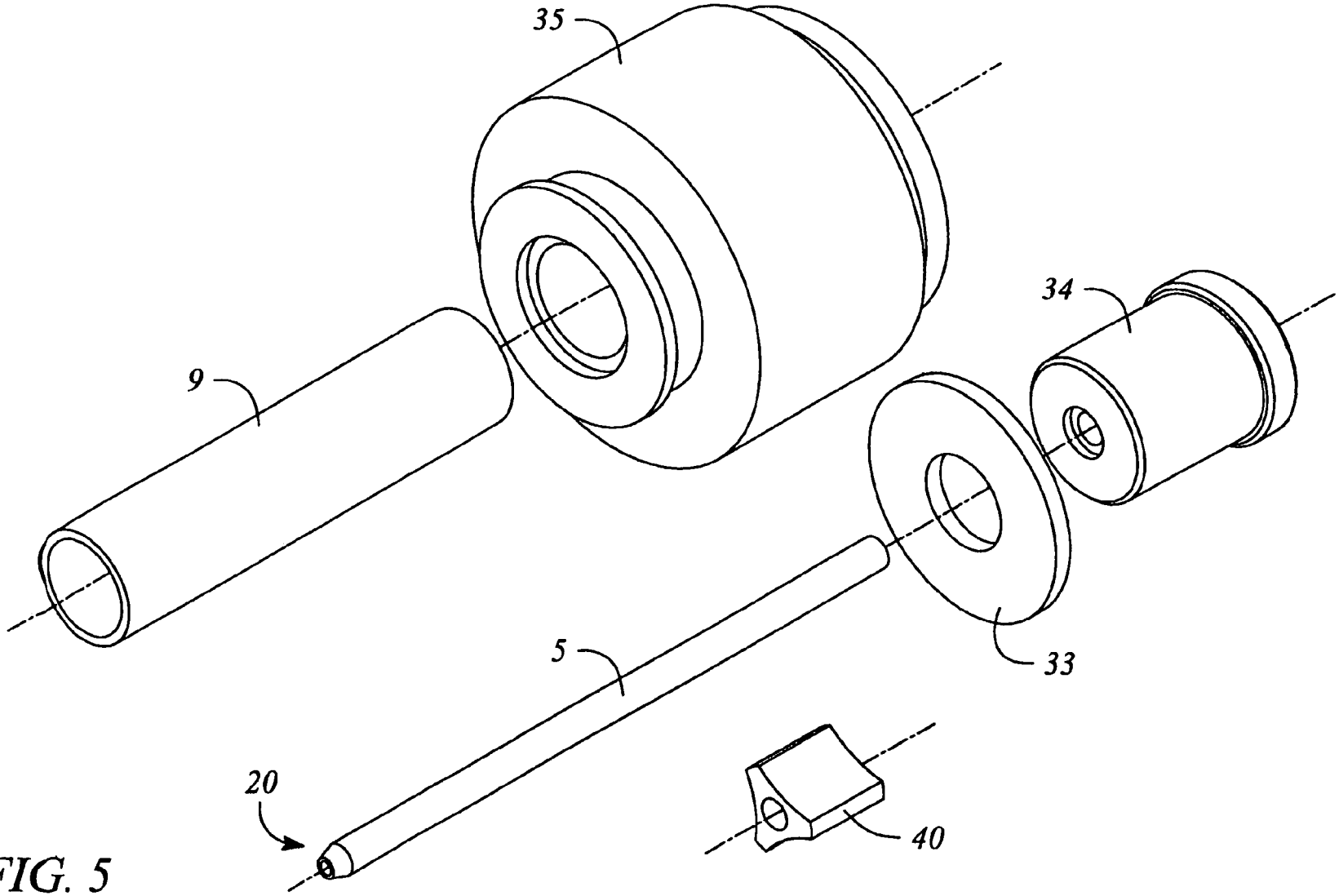
FIG. 5 shows an exploded view of the first embodiment of the invention.
Figure 6:
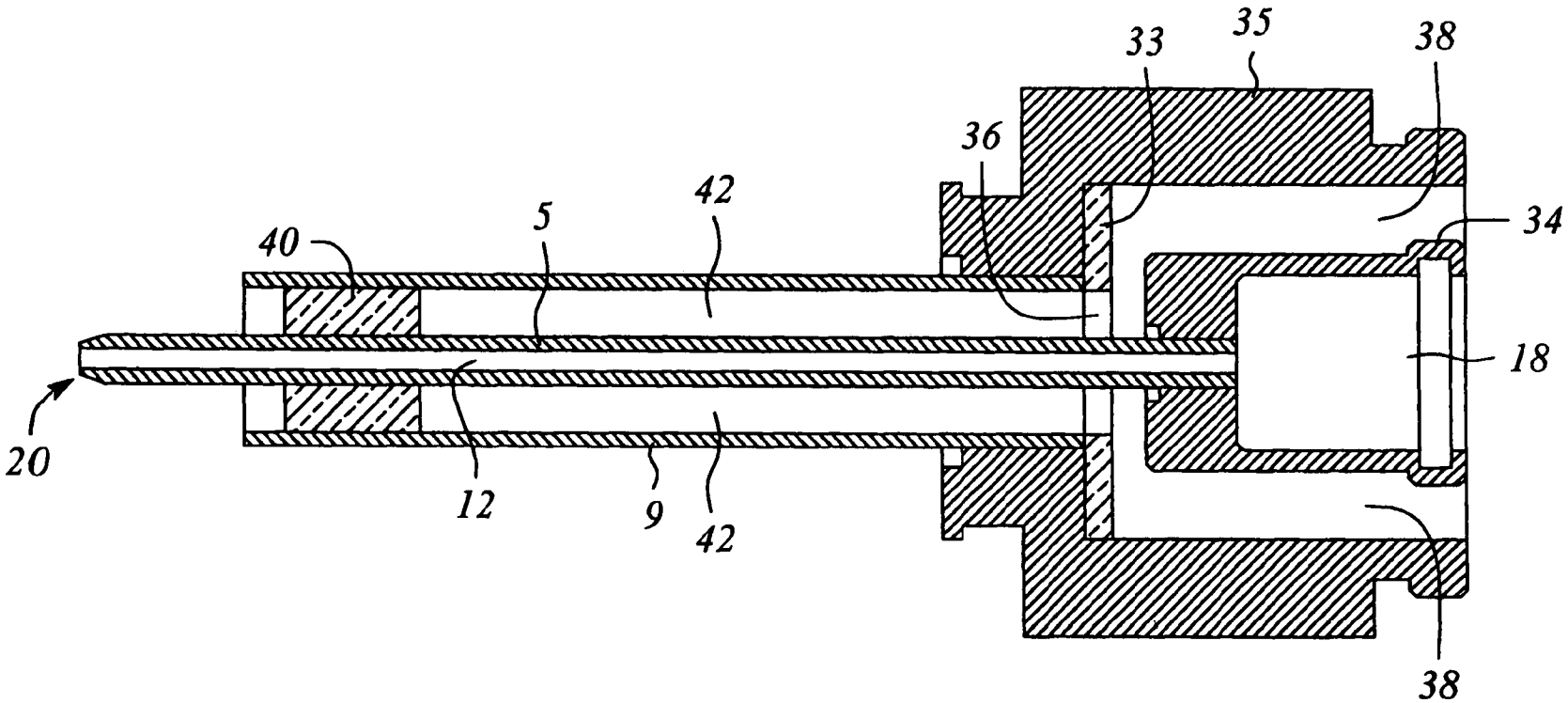
FIG. 6 shows a cross sectional view of the first embodiment of the invention.

FIGS. 2 and 4-7 illustrate the first embodiment of the invention. The conduit 9 is designed to enclose the collecting capillary 5. The conduit 9 may enclose all of the collecting capillary 5 or a portion of it. However, it is important that the conduit 9 be adjacent to the collecting capillary end 20 so that heated gas can be delivered to the analyte ions located in the ionization region 15 before they enter or are collected by the collecting capillary 5. FIGS. 1-6 and 8, show only a few embodiments of the present invention and are employed for illustrative purposes only. They should not be interpreted as narrowing the broad scope of the invention. The conduit 9 may be a separate component or may comprise a part of the coupling 23. FIGS. 4-6 show the conduit 9 as a separate component.

FIGS. 4-6 show coupling 23 and its design for joining the collecting capillary 5, the main capillary 18, and the conduit 9. The coupling 23 is designed for attaching to a fixed support 31 (shown in FIGS. 7 and 8). The coupling 23 comprises a spacer 33, a housing 35, and a capillary cap 34 (See FIG. 5). The capillary cap 34 and the spacer 33 are designed to fit within the housing 35. The spacer 33 is designed to apply pressure to the capillary cap 34 so that a tight seal is maintained between the capillary cap 34 and the main capillary 18. The capillary cap 34 is designed to receive the main capillary 18. A small gap 36 is defined between the spacer 33 and the capillary cap 34 (Sec FIG. 6). The small gap 36 allows gas to flow from the gas source 7 into the collecting capillary 5 as opposed to out of the housing 35 as is accomplished with prior art devices.

An optional centering device 40 may be provided between the collecting capillary 5 and the conduit 9. The centering device 40 may comprise a variety of shapes and sizes. It is important that the centering device 40 regulate the flow of gas that is directed into the ionization region 15. FIGS. 4-6 show the centering device as a triangular plastic insert. However, other designs and devices may be employed between the conduit 9 and the collecting capillary 5.

Referring now to FIGS. 1-8, the detector 11 is located downstream from the ion source 3 and the conduit 9. The detector 11 may be a mass analyzer or other similar device well known in the art for detecting the enhanced analyte ions that were collected by the collecting capillary 5 and transported to the main capillary 18. The detector 11 may also comprise any computer hardware and software that are well known in the art and which may help in detecting enhanced analyte ions.

In certain embodiments of the present invention, a matrix-based ion source may comprise a device for directing a plurality of streams of heated gas (e.g., at least a first and second streams of heated gas) towards the ionization region of the ion source. In these embodiments, the device may contain multiple (e.g., at least a first and second) orifices (e.g., nozzles) for directing the streams of heated gas towards the ionization region, and those orifices may be arranged around the ionization region. In certain embodiments, the orifices may be equidistant from the ionization region.

In certain embodiments, therefore, a matrix-based ion source of the invention may contain a target substrate, an ion collection capillary, an ionization region that is interposed between the target plate and the ion collecting capillary, a first conduit for directing a first stream of heated gas to the ionization region; and a second conduit for directing a second stream of heated gas to the ionization region. The matrix-based ion source may further comprise an axis of ion movement defined by the longitudinal axis of the ion collection capillary, and first and second axes of gas flow defined by the first and second conduits. The first and second axes of gas flow may be at any angle relative to the axes of ion movement, as described above.

The device may provide a plurality of streams of heated gas (e.g., at least first and second streams of heated gas) that are oriented at any angle with respect to the direction of ion flow from the target plate to the ion collection capillary (which, as described above, is the same as the longitudinal axis of the collection capillary). In a particular embodiment, the streams of heated gas are oriented orthogonally to the direction of ion flow (e.g., parallel to the surface of the target substrate), and the streams of heated gas enter the ionization region from the side. In other words, if the target substrate represents the x and y axes of 3 dimensional space, the streams of heated gas may be at any angle relative to the z axis of the same space.

As discussed above, the device may contain multiple orifices for directing a plurality of streams of heated gas towards the ionization region. In certain embodiments, the device may contain multiple conduits oriented towards the ionization region, each conduit terminating in an orifice. However, in other embodiments, the device may contain a single gas transport element containing multiple orifices that are positioned around the ionization region. In this embodiment, the gas transport element may form an open or closed ring around or above the ionization region, and the orifices of the gas transport element may be positioned to direct a plurality of streams of gas towards the ionization region.

In particular embodiments therefore, a device for providing a plurality of streams of heated gas directed towards the ionization region of an ion source may contain multiple conduits (e.g., at least 2, 3, 4 or 5 or more conduits) each having a longitudinal axis oriented towards the ionization region. In certain embodiments, the longitudinal axis of the conduits may be oriented orthogonally relative to the direction of ion flow (e.g., parallel to the surface of the target support). In alternative embodiments, a device may contain an open or closed ring-shaped gas transport element containing multiple orifices (e.g., at least 2, 3, 4 or 5 or more orifices) that direct gas in the direction of the ionization region. The gas transport element may be positioned above the ionization region or surrounding the ionization region.

Figure 11:
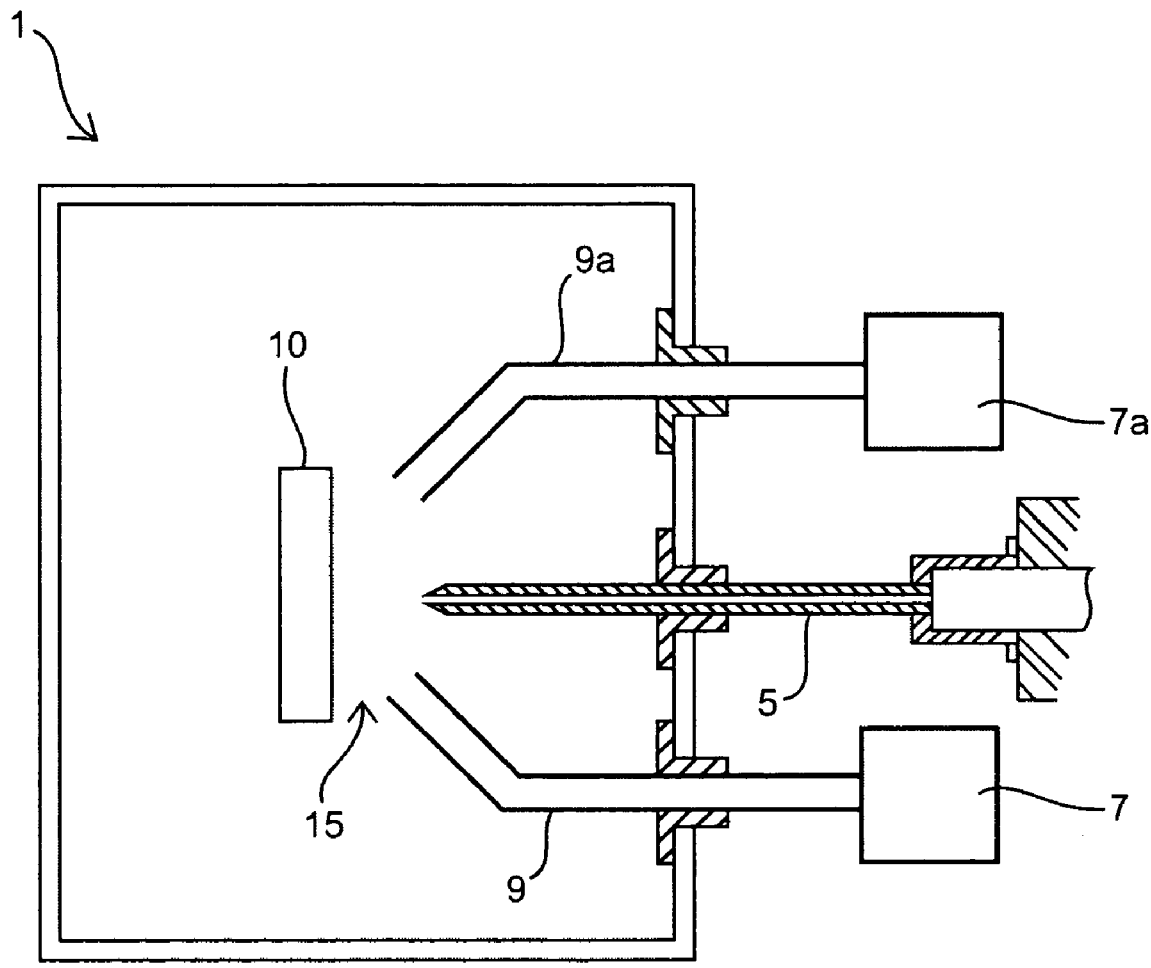
FIG. 11 shows an embodiment of the invention.

One embodiment illustrating this aspect of the invention is schematically shown in FIG. 11. In this embodiment, ion source 1 contains target substrate 10, ion collection capillary 5, an ionization region 15 that is interposed between the target plate and the ion collecting capillary; a first conduit 9 for directing a first stream of heated gas to the ionization region; and a second conduit 9*a* for directing a second stream of heated gas to the ionization region. The first and second conduits may be operably connected to gas sources 7 and 7*a*. Gas sources 7 and 7*a* may be the same gas source or different gas sources.

The device provides a plurality of gas streams that contact the ionization region from any direction, i.e., gas streams that flow towards the ionization region from any direction relative to the ionization region, including from the side (i.e., orthogonally) or any oblique angle relative to the direction of ion flow. Having described the invention and components in some detail, a description of how the invention operates is in order.

Figure 7:
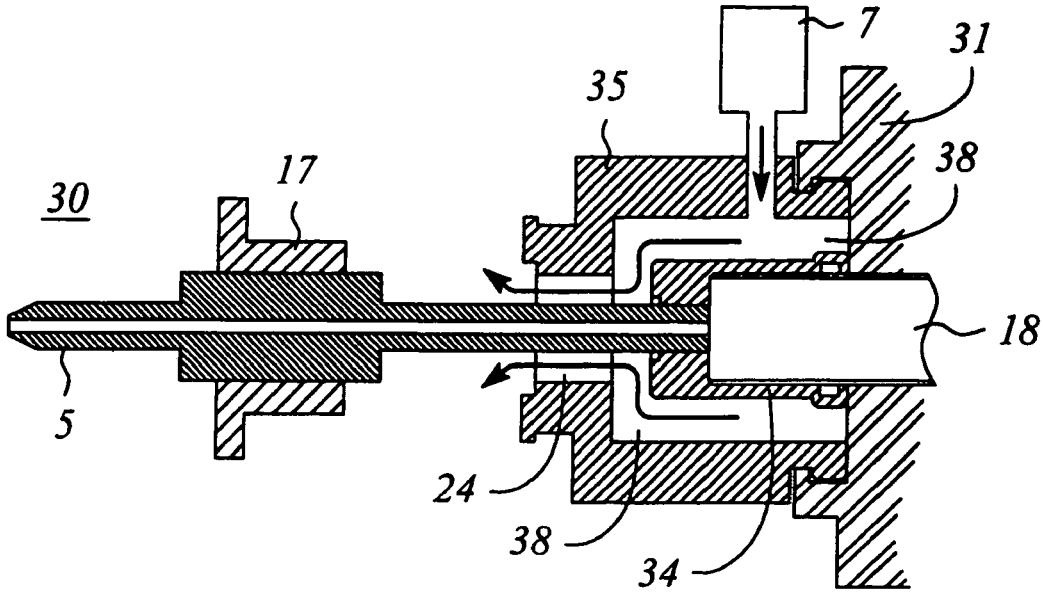
FIG. 7 shows a cross sectional view of a device.

FIG. 7 shows a cross sectional view of a device. The collecting capillary 5 is connected to the main capillary 18 by the capillary cap 34. The capillary cap is designed for receiving the main capillary 18 and is disposed in the housing 35. The housing 35 connects directly to the fixed support 31. Note that the gas source 7 provides the gas through the channels 38 defined between the housing 35 and the capillary cap 34. The gas flows from the gas source 7 into the channel 38 through a passageway 24 and then into an ionization chamber 30. The gas is released into the ionization chamber 30 and serves no purpose at this point.

Figure 8:
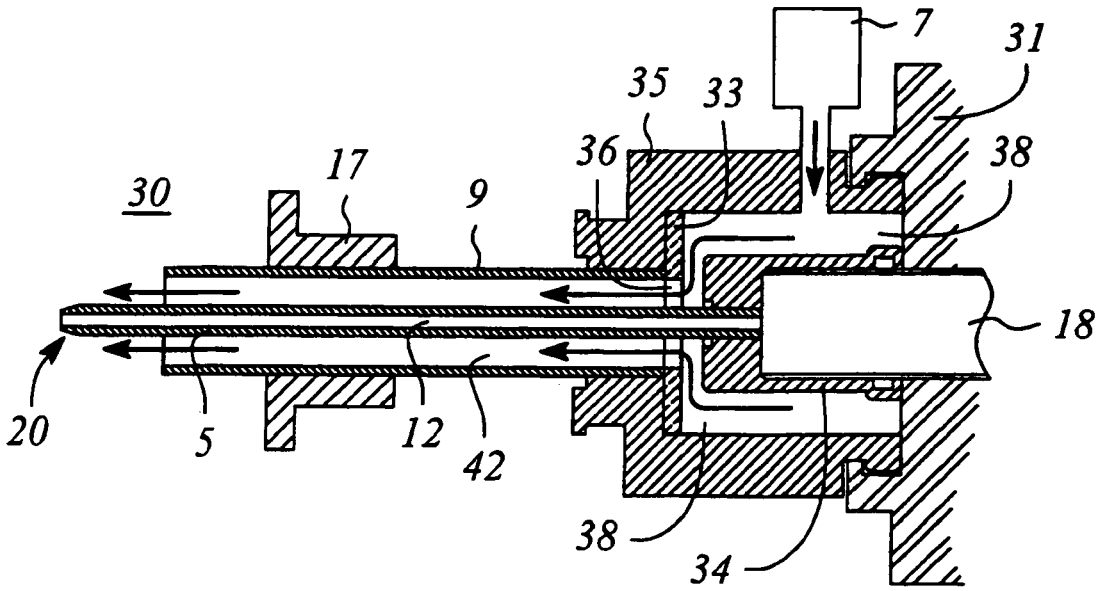
FIG. 8 shows a cross sectional view of the first embodiment of the invention and illustrates how the method of the present invention operates.

FIG. 8 shows a cross sectional view of the first embodiment of the present invention, with the conduit 9 positioned between the ion source 3 and the gas source 7. The conduit 9 operates to carry the heated gas from the gas source 7 to the collecting capillary end 20. The method of the present invention produces enhanced analyte ions for ease of detection in the mass spectrometer 1. The method comprises heating analyte ions located in the ionization region 15 adjacent to the collecting capillary 5 with a directed gas to make them more easily detectable by the detector 11. Gas is produced by the gas source 7, directed through the channels 38 and the small gap 36. From there the gas is carried into an annular space 42 defined between the conduit 9 and the collecting capillary 5. The heated gas then contacts the optional centering device 40 (not shown in FIG 5). The centering device 40 is disposed between the collecting capillary 5 and the conduit 9 and shaped in a way to regulate the flow of gas to the ionization region 15. Gas flows out of the conduit 9 into the ionization region 15 adjacent to the collecting capillary end 20. The analyte ions in the ionization region 15 are heated by the gas that is directed into this region. Analyte ions that are then enhanced are collected by the collecting capillary 5, carried to the main capillary 18 and then sent to the detector 11. It should be noted that after heat has been added to the analyte ions adjacent to the source, the detection limits and signal quality improve dramatically. This result is quite unexpected. For instance, since no solvent is used with AP-MALDI and MALDI ion sources and mass spectrometers, desolvation and/or application of a gas would not be expected to be effective in enhancing ion detection in matrix based ion sources and mass spectrometers. However, it is believed that the invention operates by the fact that large ion clusters are broken down to produce bare analyte ions that are more easily detectable. In addition, the application of heat also helps with sample evaporation.

In another embodiment, the invention provides a matrix-based ion source, in accordance with the above, in which gas is supplied to the ionization region at a pre-determined temperature. In this embodiment, the matrix-based ion source, in addition to the elements set forth above, may comprise a gas heating device. The matrix-based ion source may also contain a temperature sensor. The gas heating device, in combination with the temperature sensor, may operate in a closed feedback loop to control and maintain the temperature of the heated gas supplied to the ionization region. In certain embodiments, the temperature of the heated gas may be controlled by a human operator of the ion source and the operator may change the temperature of the heated gas as desired. FIGS. 12A-12D and 13 illustrate examples of the invention and should not limit the invention to any one particular embodiment. For example and as noted above, heated gas can be provided to an ionization region via a number of different ways, e.g., using a conduit that is coaxial with the ion collection capillary, using a conduit that is separate to the ion collection capillary, or using multiple conduits. Heated gas may be directed towards the ionization region, or in certain embodiments, the ion source may be filled, i.e., flooded with heated gas. The general principles illustrated in FIGS. 12A-12D and 13 may be applied to any of the embodiments described above.

Figure 12A:
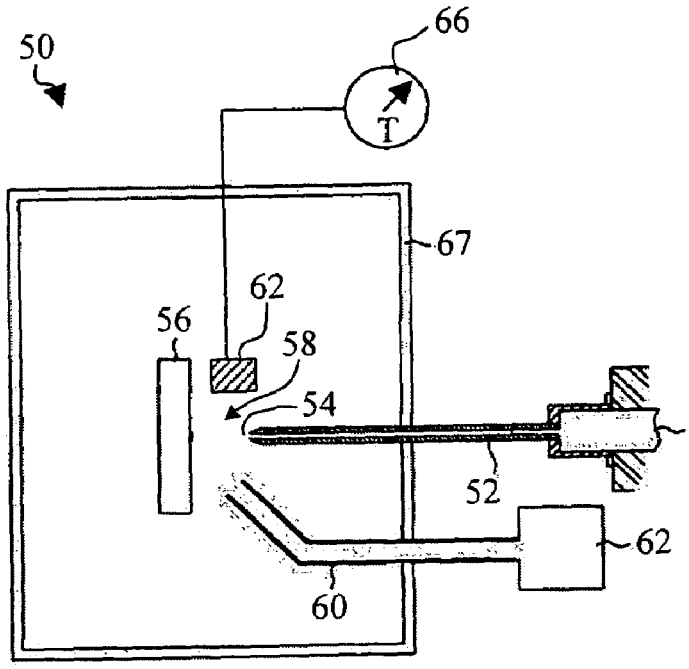
FIG. 12A-12D schematically illustrates various embodiments of an ion source containing a gas heating device.
Figure 12B:
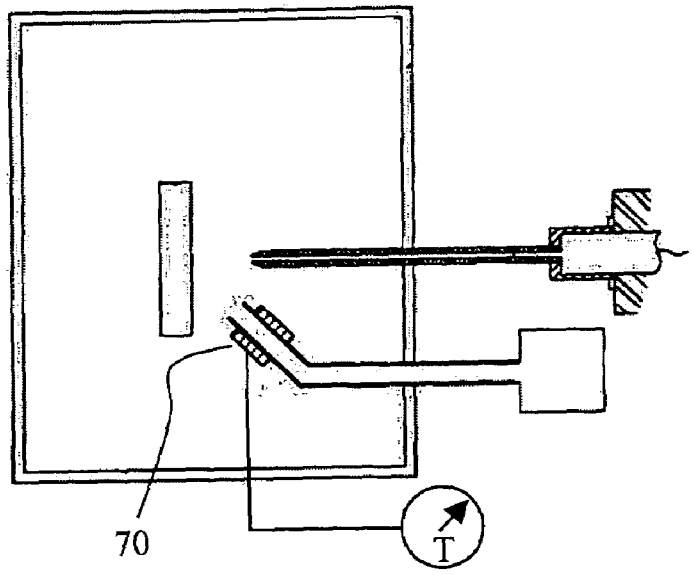
Figure 12C:
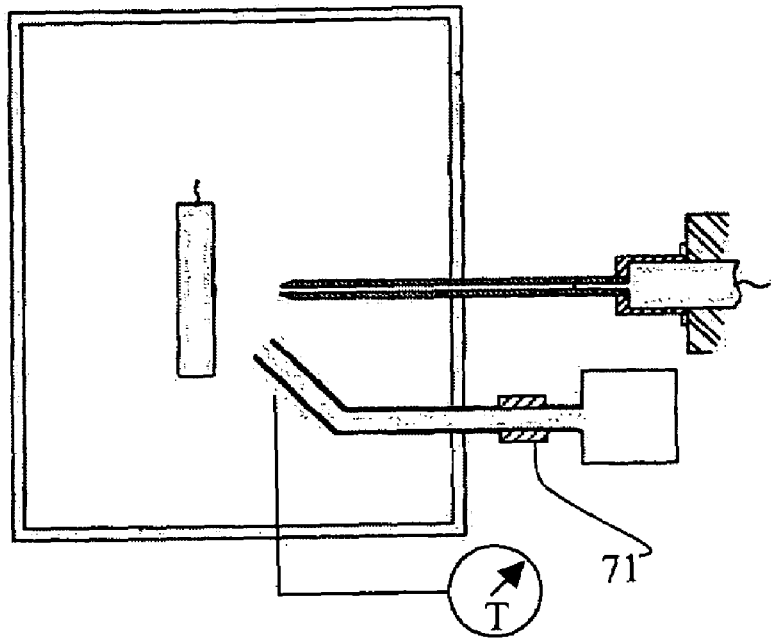
Figure 12D:
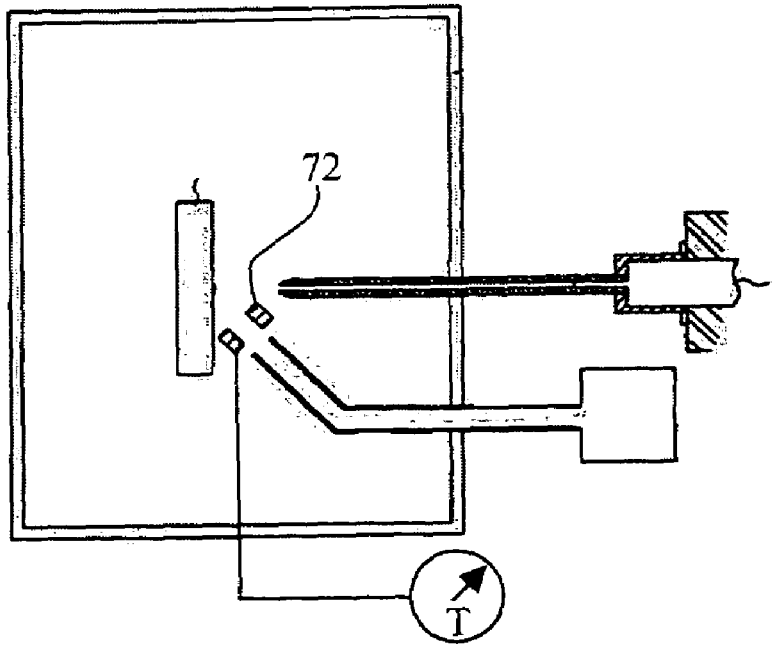

With reference to FIG. 12A, the invention provides a matrix based ion source 50 containing an ion collection capillary 52 having an ion inlet orifice 54, a target plate 56 that is adjacent to the ion inlet orifice 54, an ionization region that is interposed between the inlet orifice 54 and the sample plate 56, a conduit 60 connected to gas source 62 for supplying gas to the ionization region 58; and a gas heating device 64 for heating the gas to a defined temperature. The gas heating device 64 is generally connected to a temperature controller 66 that is disposed exterior to the ion source. Upon receiving a signal (which may be manual or automated), the temperature controller 66 may increase or decrease the power supplied to the gas heating device 62, increasing or decreasing the temperature of the gas. By increasing or decreasing the temperature of the gas heating device, the temperature of the gas may be be modulated. The gas heating device 62 may be disposed at any suitable position within the housing 67 of the ion source. The gas heating device may also be associated with (e.g., within, surrounding or as part of) the gas conduit exterior to the ion source. For example and as illustrated by element 70 in FIG. 12B, the gas heating device may be associated with the gas conduit within the housing of the ion source, as illustrated by element 71 in FIG. 12C. Alternatively, the gas heating device may be associated with the gas conduit exterior to the housing of the ion source. In one embodiment and as illustrated in FIG. 12D, the gas heating device may be positioned between the exit orifice of the gas conduit (e.g., anywhere in the gas supply line that links the gas source and the housing) and the ionization region. In other words, in certain embodiments, the gas heating element may be associated with a gas conduit so that gas is heated as it is passes through the conduit. In other embodiments, the gas heating element is not associated with the gas conduit and is situated within the housing of the ion source so that gas is heated after it exits the conduit. An ion source "comprising" a gas heating device encompasses all of the embodiments illustrated in FIGS. 12A-12D, as well as other embodiments that would be readily apparent to one of skill in the art.

Figure 13:
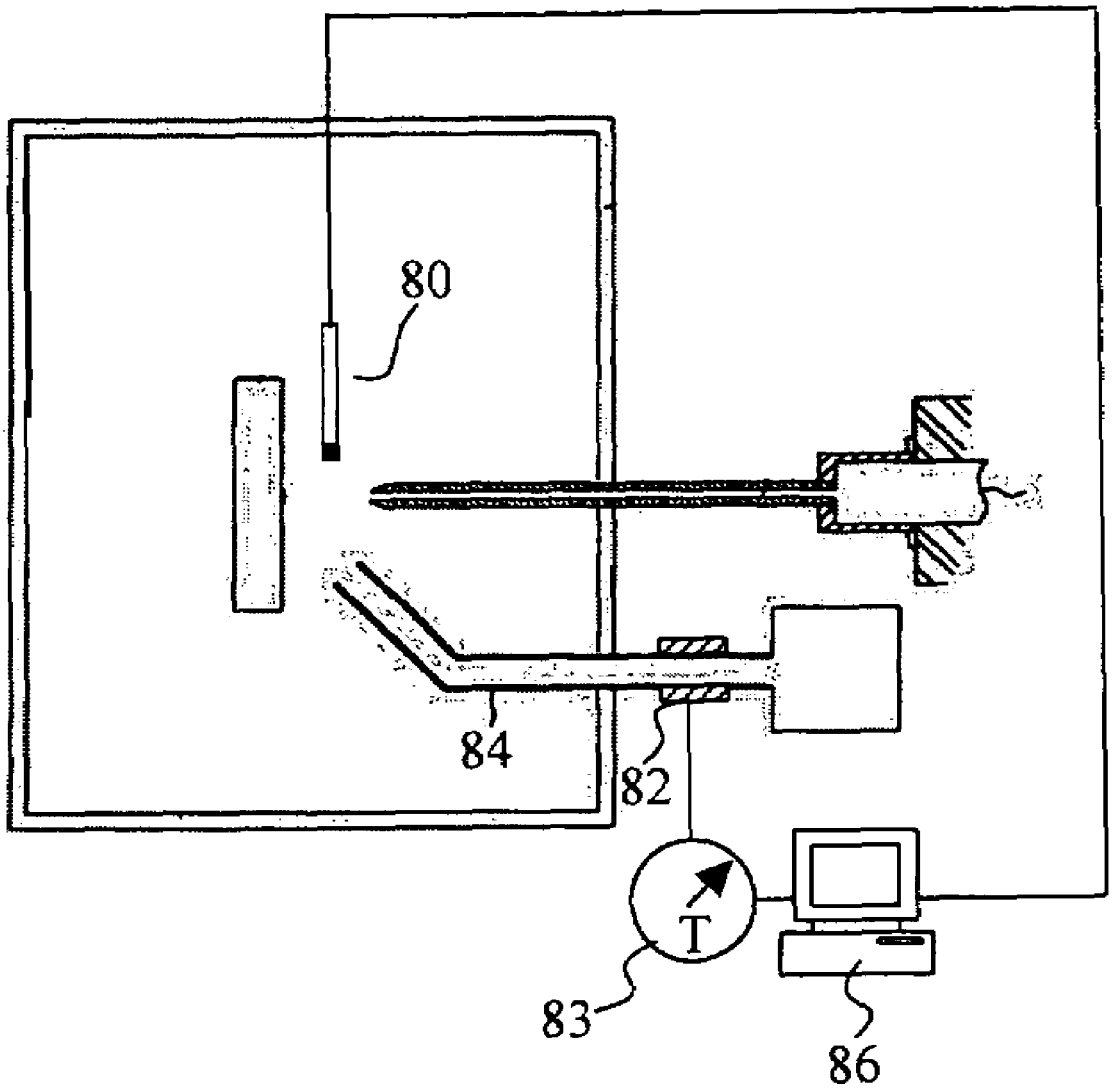
FIG. 13 schematically illustrates an ion source containing a closed feedback loop for controlling the temperature of heated gas.

As illustrated in FIG. 13, the ion source may further comprise, within the housing of the ion source, a temperature sensor 80 for monitoring the temperature of the heated gas. Like the gas heating element, temperature sensor 80 may be present at any suitable position within the ion source. In certain embodiments, however, the temperature sensor 80 may be positioned so that the temperature of gas in the ionization region can be monitored. Accordingly, and as illustrated in FIG. 13, temperature sensor 80 may be positioned within the ion source so that the probe of the sensor is adjacent to the ionization region. The temperature sensor may be any type of temperature sensor, including, but not limited to, a thermister, a thermocouple or resistance temperature detector (RTD) temperature sensor, for example, or any other temperature sensor known in the art.

As also illustrated by FIG. 13, the temperature sensor 80 and the gas heating device 82 (associated with the gas conduit 84 in this illustration for exemplification only) and temperature controller 83 may operate as a closed feedback system to maintain the temperature of the heated gas at a pre-determined temperature. In essence, the temperature sensor 80 senses the temperature of the heated gas, and, if the temperature of the heated gas is below the pre-determined temperature, the temperature controller 83 is signaled to increase the temperature of the gas heating device. Conversely, if the temperature of the heated gas is above the pre-determined temperature, the temperature controller 83 is signaled to decrease the temperature of the gas heating element. The chosen temperature may be optimized for ion cooling and de-clustering, for example. As illustrated in FIG. 13, the temperature sensor 80, gas heating device 82 and temperature controller 83 may be operably connected to a user interface 86 that displays the temperature of the heated gas. The user interface allows the operator of the ion source to view the temperature of the heated gas during ionization, monitor the temperature of the heated gas during use of the ion source, and control the temperature of the heated gas as desired. For example, in order to increase or decrease the temperature of the heated gas (in order to detect different ions, for example), the operator can enter the desired temperature via the user interface 86, the user interface directs the temperature controller 83 to increase or decrease the temperature of the gas heating device 84, as desired. Absent further changes by the operator, the heated gas will reach the desired temperature, and will be maintained at the desired temperature via the closed feedback loop.

In general terms, the closed feedback loop system allows an operator to set the temperature of the heated gas to a defined temperature. In certain embodiments, the defined temperature is in the range of about 50° C. to about 300° C., e.g., in the range of about 60° C. to about 250° C., although a pre-determined temperature outside of these ranges can be readily employed.

In particular embodiments, the invention provides a method for producing analyte ions using a matrix-based ion source. This method involves directing a plurality of streams of heated gas (e.g., a first and a second stream of heated gas) to the ionization region of the ion source, ionizing a sample to produce analyte ions; and transporting the resultant analyte ions out of the ion source.

This method provides: directing a gas at a defined temperature towards an ionization region of a matrix based ion source, ionizing a sample to produce ions, and transporting said ions out of the ion source. The method may further comprise monitoring temperature the gas, and, in certain embodiments, altering the temperature of the gas.

It is to be understood that while the invention has been described in conjunction with the specific embodiments thereof, that the foregoing description as well as the examples that follow are intended to illustrate and not limit the scope of the invention. Other aspects, advantages and modifications within the scope of the invention will be apparent to those skilled in the art to which the invention pertains.

All patents, patent applications, and publications infra and supra mentioned herein are hereby incorporated by reference in their entireties.

EXAMPLE 1

Figure 9:
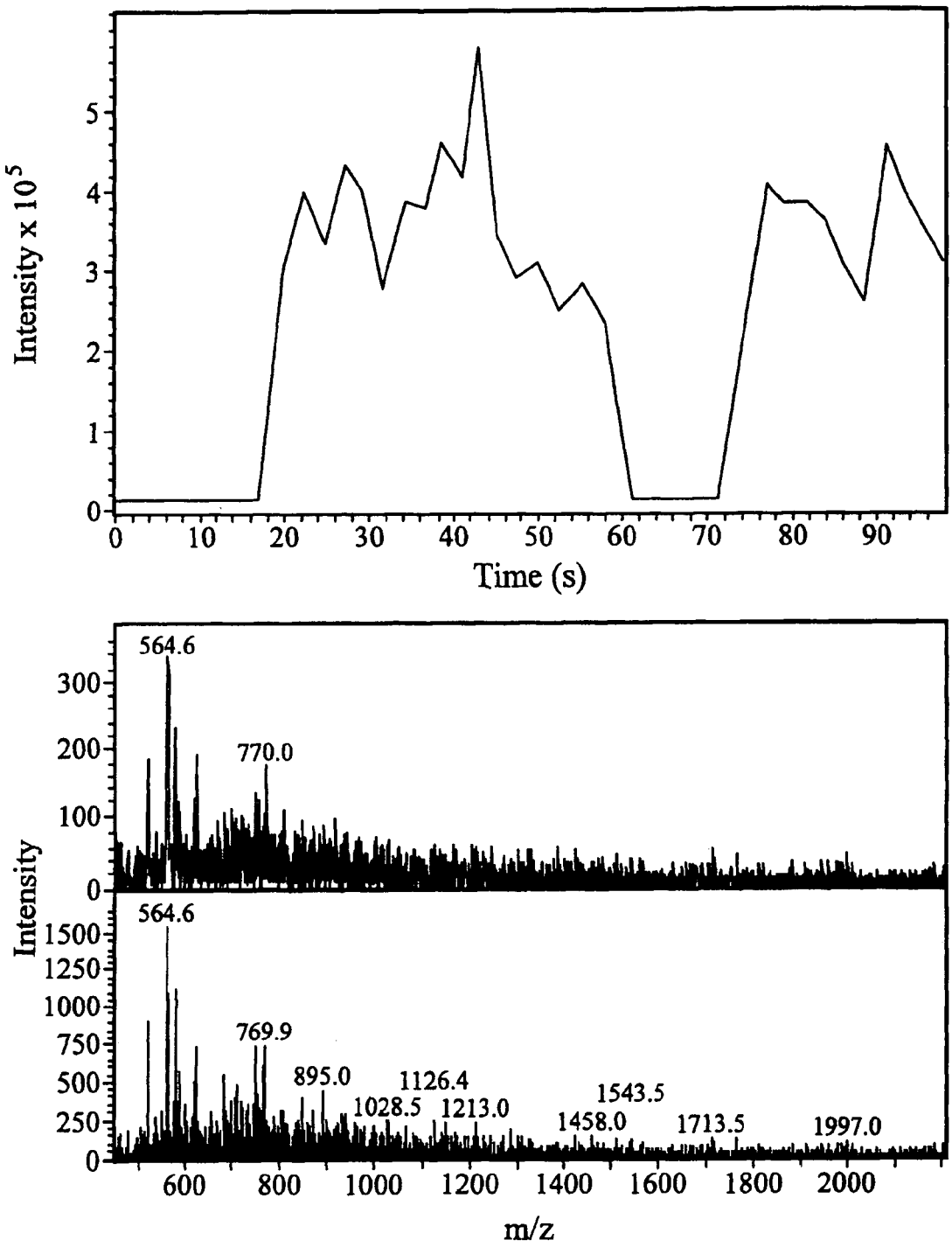
FIG. 9 shows the results of a femto molar peptide mixture without heat supplied by the present invention.

A Bruker Esquire-LC ion trap mass spectrometer was used for AP-MALDI studies. The mass spectrometer ion optics were modified (one skimmer, dual octapole guide with partitioning) and the ion sampling inlet of the instrument consisted of an ion sampling capillary extension with a conduit concentric to a capillary extension. The ion sampling inlet received a gas flow of 4-10 L/min. of heated nitrogen. A laser beam (337.1 nm, at 10 Hz) was delivered by a 400 micron fiber through a single focusing lens onto the target. The laser power was estimated to be around 50 to 70 uj. The data was obtained by using Ion Charge Control by setting the maximum trapping time to 300 ms (3 laser shots)

for the mass spectrometer scan spectrum. Each spectrum was an average of 8 micro scans for 400 to 2200 AMU. The matrix used was an 8 mM alpha-cyano-4-hydroxy-cinnamic acid in 25% methanol, 12% TPA, 67% water with 1% acetic acid. Matrix targets were premixed and 0.5 ul of the matrix/target mixture was applied onto a gold plated stainless steel target. Targets used included trypsin digest of bovine serum albumin and standard peptide mixture containing angiotensin I and IT, bradykinin, and fibrinopeptide A. Temperature of the gas phase in the vicinity of the target (ionization region) was 25 degrees Celsius. FIG. 9 shows the results without the addition of heated gas to the target or ionization region. The figure does not show the existence of sharp peaks (ion enhancement) at the higher m/z ratios.

EXAMPLE 2

Figure 10:
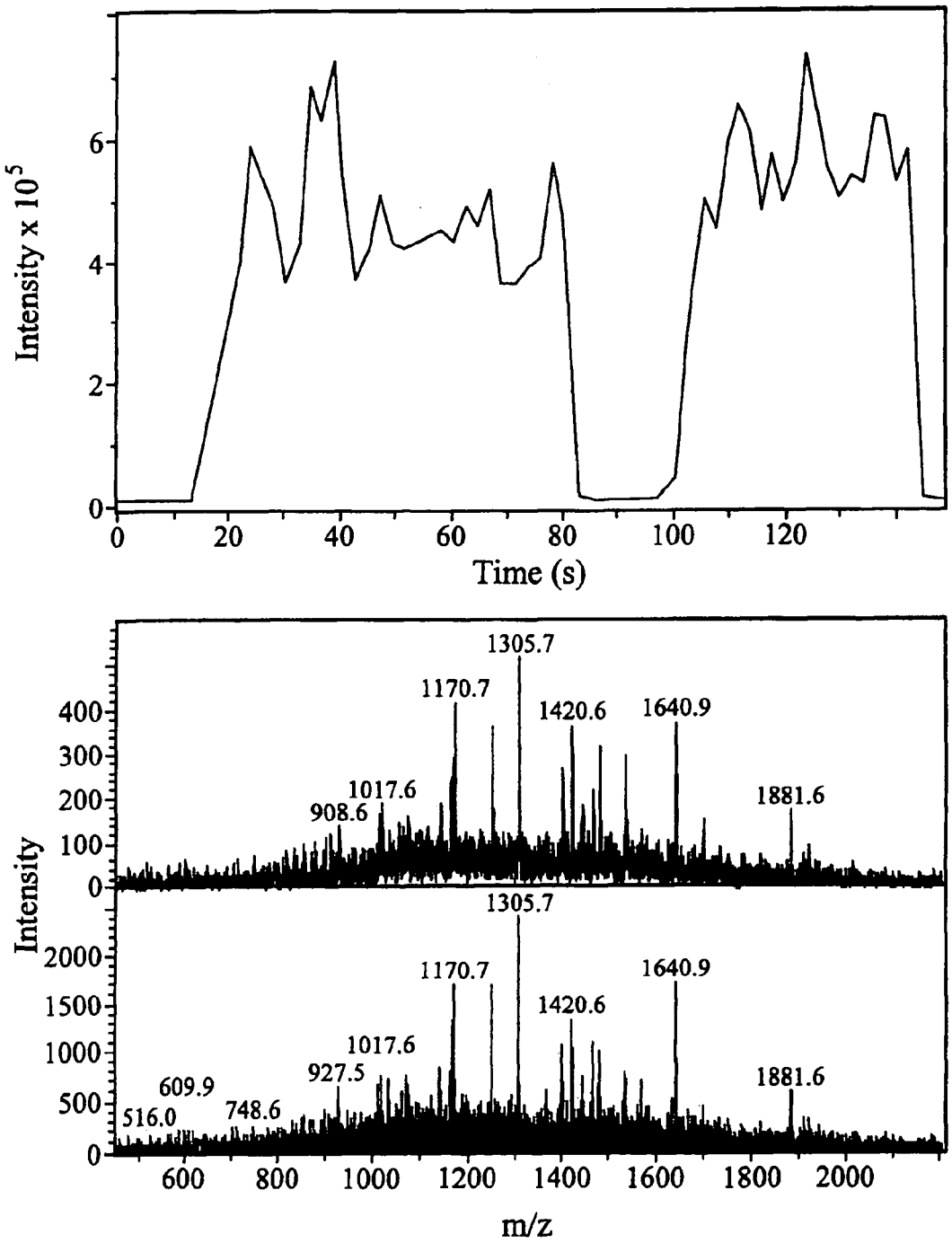
FIG. 10 shows results of a femto molar peptide mixture with the addition of heat supplied by the present invention to the analyte ions produced by the ion source in the ionization region adjacent to the collecting capillary.

The same targets were prepared and used as described above except that heated gas was applied to the target (ionization region) at around 100 degrees Celsius. FIG. 10 shows the results with the addition of the heated gas to the target in the ionization region. The figure shows the existence of the sharp peaks (ion enhancement) at the higher m/z ratios.

We claim:

1. A matrix-based ion source comprising:
an ion collection capillary having an ion inlet orifice;
a target plate that is adjacent to said ion inlet orifice;
an ionization region that is interposed between said inlet orifice and said target plate;
a conduit for supplying gas to said ionization region;
a gas heating device for heating said gas to a defined temperature; and
a temperature sensor disposed in the ion source for monitoring temperature of said gas.

2. The matrix-based ion source of claim 1, wherein said temperature sensor is a thermostat.

3. The matrix-based ion source of claim 1, wherein said temperature sensor comprises a thermistor, thermocouple or resistance temperature detector (RTD) sensor.

4. The matrix-based ion source of claim 3, wherein said temperature sensor and said gas heating device are operably connected and operate in a closed feedback loop to maintain said gas at a constant temperature.

5. The matrix-based ion source of claim 4, wherein said temperature sensor and said gas heating device are operably connected to a user interface that displays said temperature of said heated gas.

6. The matrix-based ion source of claim 5, wherein said user interface allows an operator to change said temperature of said heated gas.

7. The matrix-based ion source of claim 1, wherein said defined temperature is in the range of about 50° C. to about 250° C.

8. The matrix-based km source of claim 1, wherein said defined temperature is in the range of about 60° C. to about 200° C.

9. The matrix-based ion Source of claim 1, wherein said gas heating device is disposed within said ion source.

10. The matrix-based ion source of claim 1, wherein said matrix-based ion source is operably connected to a source of gas.

11. The matrix-based ion source of claim 10, wherein said gas heating device is disposed exterior to said ion source and associated with said conduit.

12. The matrix-based ion source of claim 1, wherein said ion source is operated at above 100 mTorr.

13. The matrix-based ion source of claim 1, wherein said ion source is operated at atmospheric pressure.

14. A matrix-based ion source comprising:
an ion collection capillary having an ion inlet orifice;
a target plate that is adjacent to said ion inlet orifice;
an ionization region that is interposed between said ion collection capillary and said target plate;
a conduit for supplying gas to said ionization region;
a gas heating device for heating said gas to a defined temperature; and
a sensor for sensing temperature of said heated gas in said ion source;
wherein said sensor and said gas heating device are operably connected and operate in a closed feedback loop to maintain said heated gas at a pre-defined temperature.

15. The matrix-based ion source of claim 14, wherein said gas heating device and said sensor are coupled to a user interface that is exterior to said ion source.

16. The matrix-based ion source of claim 14, wherein said user interface allows an operator to alter said temperature of said heated gas.

17. A mass spectrometer system comprising:
a) a matrix-based ion source comprising:
an ion collection capillary having an ion inlet orifice;
a target plate that is adjacent to said ion inlet orifice;
an ionization region that is interposed between said ion collection capillary and said target plate;
a conduit for supplying heated gas to said ionization region; and
a gas heating device for heating said gas to a defined temperature; and
b) an ion transport system downstream from said matrix-based ion source; and
c) an ion detector downstream from said ion transport system.

18. The mass spectrometer system of claim 17, further comprising a temperature sensor in said matrix-based ion source for monitoring temperature of said heated gas.

19. The mass spectrometer system of claim 18, wherein said temperature sensor and said gas heating device operate in a closed feedback loop to maintain said heated gas at a constant temperature.

20. The mass spectrometer system of claim 17, wherein said temperature sensor and said gas heating device are operatively connected to a user interface that displays the temperature of said heated gas.

21. The mass spectrometer system of claim 20, wherein said user interface allows an operator to change the temperature of said heated gas.

22. The mass spectrometer system of claim 17, wherein said ion source is operated at atmospheric pressure.

23. The mass spectrometer system of claim 17, wherein said ion source is operated at above 100 mTorr.

24. A method of producing ions in a matrix-based ion source, comprising:
directing a gas at a defined temperature towards an ionization region of a matrix based ion source;
ionizing a sample to produce ions;
transporting said ions out of said ion source.

25. The method of claim 24, further comprising monitoring the temperature said gas.

26. The method of claim 24, further comprising altering the temperature of said gas.

* * * * *